US005217391A

United States Patent [19]

Fisher, Jr.

[11] Patent Number: 5,217,391

[45] Date of Patent: Jun. 8, 1993

[54] MATABLE COAXIAL CONNECTOR ASSEMBLY HAVING IMPEDANCE COMPENSATION

[75] Inventor: Robert L. Fisher, Jr., Palmyra, Pa.

[73] Assignee: AMP Incorporated, Harrisburg, Pa.

[21] Appl. No.: 906,258

[22] Filed: Jun. 29, 1992

[51] Int. Cl.[5] ..... H01R 13/00

[52] U.S. Cl. ..... 439/578

[58] Field of Search ..... 439/578-585

[56] References Cited

U.S. PATENT DOCUMENTS

| | | | |
|---|---|---|---|
| 4,326,769 | 4/1982 | Dorsey et al. | 439/578 |
| 4,426,127 | 1/1984 | Kubota | 339/177 R |
| 4,697,859 | 10/1987 | Fisher, Jr. | 439/246 |
| 4,789,351 | 12/1988 | Fisher, Jr. et al. | 439/248 |
| 4,917,630 | 4/1990 | Hubbard | 439/578 |
| 5,021,010 | 6/1991 | Wright | 439/578 |
| 5,037,328 | 8/1991 | Karlovich | 439/578 |
| 5,062,808 | 11/1991 | Hosler, Sr. | 439/580 |

OTHER PUBLICATIONS

Phoenix Brochure: "The PkZ Connector: Blindmate Technology DC to 32 GHz", pp. 1-10; date unknown; The Phoenix Company of Chicago, Inc.

AMP Catalog 80-570, "Guide to RF Connectors", Revision May, 1990; pp. 172-176; AMP Incorporated, Harrisburg, Pa.

*Primary Examiner*—Joseph H. McGlynn

*Attorney, Agent, or Firm*—Anton P. Ness

[57] ABSTRACT

A coaxial connector assembly (10) includes a plug (40) and jack (140) having respective inner and outer conductors matable at a mating interface. The mating interface (MI) includes a plurality of regions A,B,C of mismatched impedance having varying axial lengths defined by diameter changes of said inner and outer conductors of the plug (40) and jack (140) between respective dielectric bodies (50,162) thereof upon mating. A reduced diameter portion of the plug's outer conductor (52) inwardly from its leading end corresponds with an increased diameter of the plug's inner conductor (46) and is engaged by leading ends (176) of spring arms (170) of a reduced diameter leading end of the jack's outer conductor (160). The leading ends (176) of the spring arms (170) engage the inward surface of the reduced diameter portion of the plug's outer conductor (52) within a range of axial locations accommodating variations in the locations of the plug (40) and jack (140) upon full mating. The reduced diameter portion can be defined by a conductive sleeve (80) force fit within a front shell (52) forwardly of dielectric body (50) containing inner conductor (46) of the plug (40) until its leading edge (88) coincides axially with a shoulder (78) of the plug's inner conductor (46) between the pin contact section (62) and a larger diameter body section thereof.

11 Claims, 15 Drawing Sheets 172
176
170
165
184
18
164
148
162
160
140
178
174
154
14
180
166
146
182
34
210
156
150
32
208
24
206
204
196
190
194
192
202
198
200
212

MATABLE COAXIAL CONNECTOR ASSEMBLY HAVING IMPEDANCE COMPENSATION

FIELD OF THE INVENTION

The present invention relates to an electrical coaxial connector assembly of matable coaxial connectors, and more particularly to the field of coaxial connectors providing compensation for impedance.

BACKGROUND OF THE INVENTION

Typical coaxial connection systems such as radiofrequency (RF) connection systems are cable-to-cable assemblies and comprise a plug and jack affixed to coaxial cables. Such matable plug and jack connectors are disclosed generally in U.S. Pat. Nos. 4,789,351; 4,697,859; 4,426,127 and 4,917,630. An example of a coax connector of a design in accordance with a generally accepted industry standard, is sold by AMP Incorporated, Harrisburg, Pa. under the designation Size 8 Contacts, Part Nos. 228618-5 and 228596-5, suitable for use in connections having a frequency of about 1 gigaHertz maximum. An inner conductor is disposed within a dielectric sleeve, all retained within an outer conductor so that the inner conductor is precisely concentric within the outer conductor, and with opposing metal surfaces having selected precise diametrical relationships at all axial locations. The inner conductors are matable pin and socket contact sections, and the outer conductors are matable as a cylindrical plug within an array of cantilever beam arms of a receptacle.

In U.S. Pat. No. 4,789,351 is disclosed an electrical connector comprised of intermating halves including snap rings, a shroud and sleeve of geometries allowing blind mating of the connector halves with both halves being readily snapped into apertures of housings and assuring proper mating with varying parts tolerances; the outer conductor of the jack receives thereinto the forward end of the outer conductor of the plug comprised of inwardly deflectable cantilever spring beams to be abuttable with a ledge inside the plug outer conductor, with the mating connection all within a conductive shroud, and an axial spring element forwardly of the retention ring provides spring bias to the outer conductor of the jack relative to the housing to accommodate tolerance variations in parts and still maintain an intimate end butting contact with the opposite connector half.

In U.S. Pat. No. 4,697,859 is disclosed fixedly mounting the jack within a rack, whereas the plug is spring loadably mounted to a panel; the entire plug member including the conductive shroud, the center conductor and the coaxial cable can float to accommodate the axial and radial misalignment, thus being especially useful in a rack and panel or "blindmate" situation for remotely located connection. An example of such a connector assembly is sold by AMP Incorporated of Harrisburg, Pa. under the designation AMP 2.8 Blind Mate coax having Part Nos. 413242-1 and 413249-1, and provides high signal integrity at frequency rating of 40 gigaHertz.

A coaxial connector assembly providing constant impedance across the entire length of the mated connection is disclosed in U.S. Pat. No. 4,917,630. The inner and outer conductors on both plugs of the pair are of unequal lengths such that one projects beyond the other. The longer inner conductor from one plug and the longer outer conductor from the other plug are designed to overlap each other when the connector is first electrically connected and only partially engaged, thereby defining an overlap region; the inner and outer conductors are constrained to be axially aligned for mating. Diameters of the opposed surfaces of the inner and outer conductors in the overlap region are chosen to provide a matching impedance to the impedance elsewhere in the connector, thus producing a constant impedance along the length of the connector, even when the connector is only partially engaged, resulting in the axial length of the overlap region varying from connection to connection. An example of a product of this general design is sold by The Phoenix Company of Chicago, Inc. under the designation "PkZ Connector", said to provide high signal integrity at up to a frequency rating of 32 gigaHertz.

In U.S. patent application Ser. No. 07/720,123 filed Jun. 24, 1991, it is disclosed to provide a coaxial connection comprising pin and socket terminals where the pin terminal is mounted by a dielectric body coaxially within an outer conducive ring, and where the socket terminal is held within an outer conductive sleeve by way of a dielectric sleeve. The outer conductive sleeve has a conductive shroud having resilient fingers adapted for coaxial engagement within the outer conductive ring. The pin terminal is coaxially positioned within the conductive shroud when mated with the socket. The conduction is characterized in that various regions of mismatched impedances are positioned intermediate the dielectric body and the dielectric sleeve, the lengths of the regions varying with the axial position of the pin relative to the socket, the regions being adapted to create reflection signals at transition positions between adjacent regions, where the refection signals are substantially self canceling in summation, thereby preventing power loss.

It is desired to provide a matable coaxial plug and jack connection system having compensation for impedance.

It is further desired to provide such a connection system wherein no spring member is required to generate axial bias on the conductors in order to attain impedance compensation, thereby lowering the requisite mating force of a multiposition connector.

It is additionally desired to provide a coaxial connection system providing high signal integrity in the frequency range of about 10 to 30 gigaHertz and higher.

It is also desired that such coaxial connection system be especially forgiving of axial and radial misalignment.

SUMMARY OF THE INVENTION

The present invention is a plug and jack connector assembly for coaxial cables, or for circuit boards, or for cable-to-board applications, wherein the reflection signals are substantially self canceling in summation, thereby preventing power loss. The coax connector assembly of the present invention is thus adapted for use in multiposition hybrid connectors having a plurality of such coax connectors in addition possibly to other types of contacts and connectors, tolerating axial and radial misalignment through an imp dance self compensating interface without requiring bottoming of the conductors of the mating plug and jack connectors nor requiring spring loading of the outer conductors to effectuate such bottoming. The plug and jack connectors being matable without biasing spring members are therefore substantially independent of reference to the housings within which the connectors are retained.

In the plug connector the pin terminal or center conductor is mounted within a dielectric body coaxially within an outer conductive ring and immediately forwardly of the dielectric body is a conductive sleeve of short axial length and precise inner diameter. In the jack connector the socket terminal is similarly held within an outer conductive sleeve by way of a dielectric body. The outer conductive sleeve has a conductive shroud having resilient fingers extending forwardly from a larger diameter section of the shroud and forwardly of the socket contact section of the terminal, the fingers adapted for coaxial engagement within the outer conductive sleeve while the larger diameter shroud section is received into the forward end of the conductive ring.

The pin terminal is coaxially positioned within the conductive shroud when mated with the socket terminal. A larger diameter section of the pin terminal extends rearwardly from an axial position of the leading end of the conductive sleeve and at least into the dielectric body, creating two regions of changing diameter relationships within the plug connector. The leading end of the spring arms of the shroud of the jack connector engage the inner surface of the conductive sleeve within a region extending between the leading end of the sleeve and the dielectric body, and the bases of the spring arms are joined to the continuous circumference of the reduced diameter leading end of the cylindrical section at a location preferably axially coincident with the forward end of the dielectric body containing the socket contact section recesses therebehind.

Three regions of impedance mismatch exist, when the connectors are mated, with the first regions of both connectors coextending for varying lengths depending on the spacing between the housings in which the connectors are mounted which determines the extent to which the leading ends of the spring arms extend into the conductive sleeve, thus leaving variable axial lengths of the second regions outside the region of coextension of the first regions. Thus regions of mismatched impedances are created having varying lengths from connector to connector, the regions being adapted to create reflection signals at transition positions between adjacent regions, whereby the reflection signals are substantially self canceling in summation, thereby preventing power loss. Together the three regions define the mating interface between the forward ends of the dielectric bodies containing the inner conductors.

It is an objective of the present invention to provide a coaxial connector mating interface which provides inherent compensation for impedance for a range of mating positions.

It is additionally an objective to provide a coaxial connector providing signal integrity in a range of frequencies of between 1 and 30 gigaHertz, and especially between about 10 and 12 gigaHertz.

It is also an objective for coaxial connection systems having such inherent impedance compensation for cable-to-cable interconnection and for board-to-board interconnection or cable-to-board interconnection.

It is a further objective for such coaxial connection systems to be selfcompensating without axial spring mechanisms assuring achievement of a single mating position, thus reducing mating forces in multiposition connector assemblies or hybrid connector assemblies.

It is additionally an objective for the selfcompensating mating interface to be compatible with connectors adapted for mating within a limited range of angular misalignment, thus being especially suitable with integration of the connector assembly in a multiposition connector housing or board-to-board interconnection.

Embodiments of the present invention will now be described by way of example with reference to the accompanying drawings.

BRIEF DESCRIPTION OF THE DRAWINGS

FIGS. 13 to 15 are longitudinal section views of mated assemblies of other styles of coaxial connections having the mating interface of the present invention, with FIG. 13 adapted for crimped connections with a pair of terminated cables, FIG. 14 adapted for solder connections with a pair of terminated semirigid coaxial cables, and FIG. 15 adapted for board-to-board connection using a right angle board mountable connector and a straight-in board mountable connector.

DETAILED DESCRIPTION OF THE PREFERRED EMBODIMENT

Figure 1:
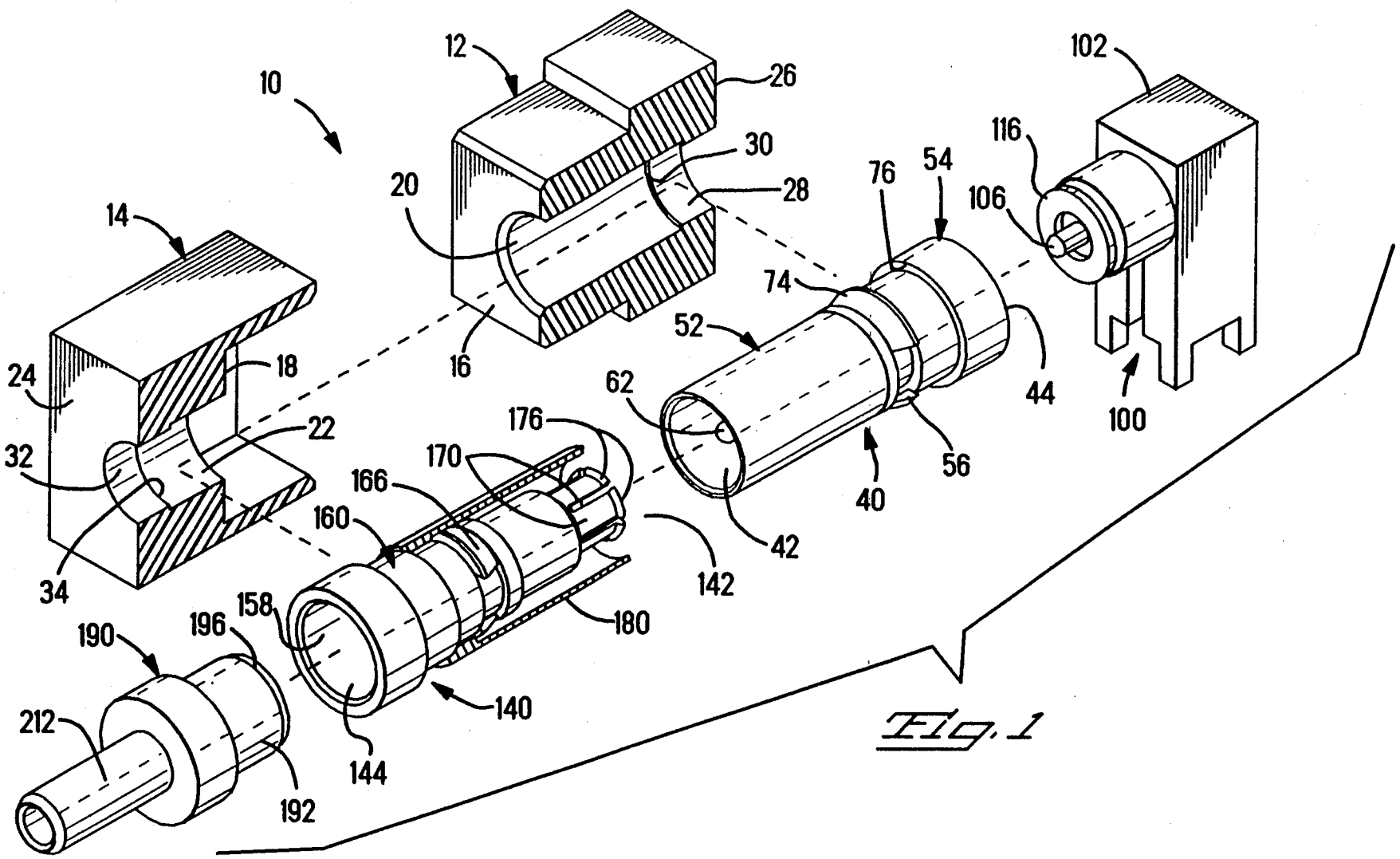
FIG. 1 is a perspective view of a matable pair of coaxial connectors of the present invention.

Referring first to FIG. 1 and to an embodiment of a coaxial connector assembly employing the features of the invention, the connector is shown as 10 comprised of a plug assembly half 40 and a jack assembly half 140 mountable respectively in apertures of housings 12 and 14. Plug 40 is shown having a right angle circuit board coaxial connector 100 connectable at a rearward end thereof, while jack 140 is shown adapted to be connected to a terminated coaxial cable at its rearward end. Upon being secured in housings 12,14 plug 40 and jack 140 would be matable at a mating coaxial interface defined between respective mating faces 42,142 exposed at the mating faces 16,18 of the opposed housings, when the housings are moved axially and matingly together. The plug 40 and jack 140 are depicted prior to being inserted into apertures 20,22 within such housings, and prior to transition interfaces 44,144 exposed at rearward faces 24,26 of housings 12,14 being interconnected with a terminated coaxial cable end and a circuit board-mountable coaxial connector 100 respectively (see FIGS. 4 to 7), although the plug and jack may be affixed to cable ends or connectors prior to shipment, for convenience. The connectors are shown designed to be mountable and retainable, and removable from, apertures of standard or conventional design and dimension.

The housings 12 and 14 shown only in part in FIG. 1, may be taken to be wall sections of either panels which can contain a plurality of connectors like 10, or a section through a wall of a connector containing a plurality of connectors 10 and in addition, other connectors for signal, power and ground such as hybrid connectors; the connectors may further be of the type including fiber optic connectors. One type of hybrid connector is disclosed in U.S. patent application Ser. No. 07/855,364 filed Mar. 20, 1992 and assigned to the assignee hereof. Not shown, but understood to be included, would be features mounted on or forming part of the housings including mechanical fasteners adapted to align the housings for mutual closure to effect an interconnect of the connector halves.

Figure 2:
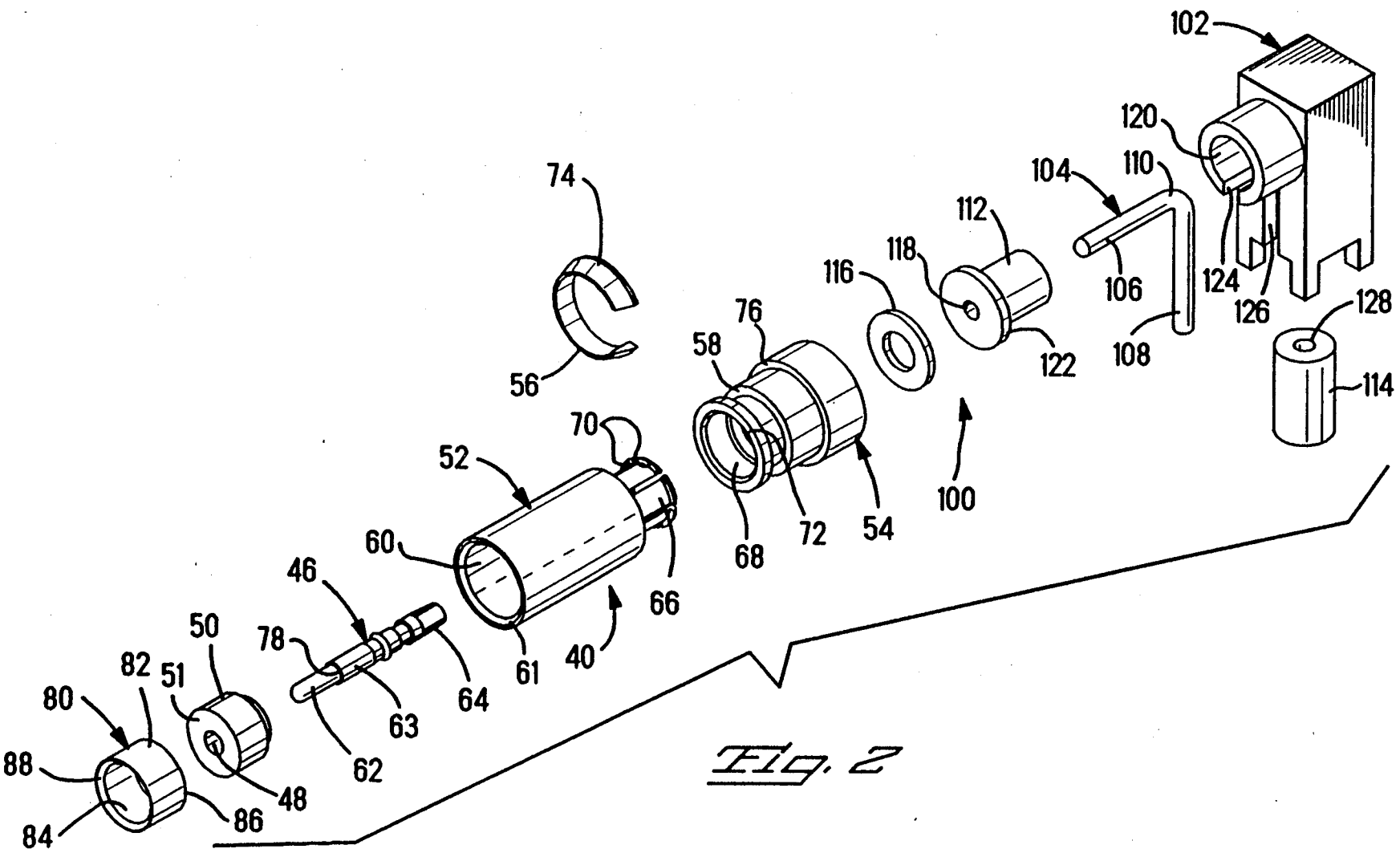
FIGS. 2 and 3 are exploded perspective views of the matable connectors of FIG. 1.

Referring to FIGS. 1 and 2, plug 40 generally has a construction of an inner or central contact 46 mounted within a passageway 48 of dielectric body 50, a front conductive shell 52, and a rear shell 54 receiving a retention snap ring 56 therearound into an annular recess 58, with front and rear shells 52,54 defining an outer conductor. Inner contact 46 and dielectric body 50 are retained concentrically within a bore 60 of front shell 52 defining a front shell subassembly, with inner contact 46 including a pin contact forward section 62, a body section 63 and a socket contact rearward section 64. Plug 40 further includes an inner conductive sleeve 80 inserted into bore 60 of front shell 52 forwardly of dielectric body 50 in interference fit, for purposes to be discussed later with respect to FIGS. 6 to 9.

Front shell 52 includes a cylindrical array of spring arms 66 extending from the rearward section, enabling the front shell subassembly to be secured to rear shell 54, spring arms 66 being insertable into the front portion of bore 68 of rear shell 54 and outwardly extending forwardly facing latching surfaces 70 latchable behind rearwardly facing ledge 72 (see FIG. 4) of bore 68, defining plug connector 40. Snap ring 56 in its unbiased state has an outer diameter larger than small diameter aperture portion 28 but is deflectable to a smaller outer diameter. The forward portions of plug 40 are shaped and dimensioned to be insertable into aperture 20 from rearward face 26 until snap ring 56 passes through small diameter aperture portion 28 and resiles forwardly of ledge 30, with outwardly tapered surface 74 engaging the housing aperture walls to initiate radially inward deflection, facilitating insertion. Rear shell 54 includes a larger diameter rear portion defining an annular stop 76 which abuts against rearward housing face 26 preventing further axially forward motion.

Also seen in FIGS. 1 and 2 is right angle circuit board coaxial connector 100 connectable to plug 40 at transition interface 44 thereof. Coaxial connector 100 has an outer shell 102, an inner contact 104 with first and second pin contact sections 106,108 extending from a right angle bend 110, a first dielectric body 112 associated with first pin section 106, a second dielectric body 114 associated with second pin section 108, and a spacer 116. First pin section 106 extends through passageway 118 of first dielectric body 112 and then inserted into bore 120 of outer shell 102 until flange 122 of body 112 abuts outer shell 102; second pin section follows gap 124 during insertion and passes through gap 126, after which second dielectric body 114 is inserted into outer shell 102 with second pin section 108 entering passageway 128 thereof.

In the preferred embodiment of the invention, the pin 46 is beryllium copper, dielectric body 50 is polytetrafluoroethylene (PTFE), front shell 52 is beryllium copper while rear shell 54 may be brass, with the pin contact and front and rear shells being plated with gold over nickel, and retention snap ring 56 may be nickel-plated beryllium copper. Regarding connector 100, contact 104 may be brass plated with gold over nickel, outer shell 102 may be machined of brass and tin-lead plated, dielectric bodies 112,114 may be PTFE, and spacer 116 may be nickel-plated brass.

Figure 3:
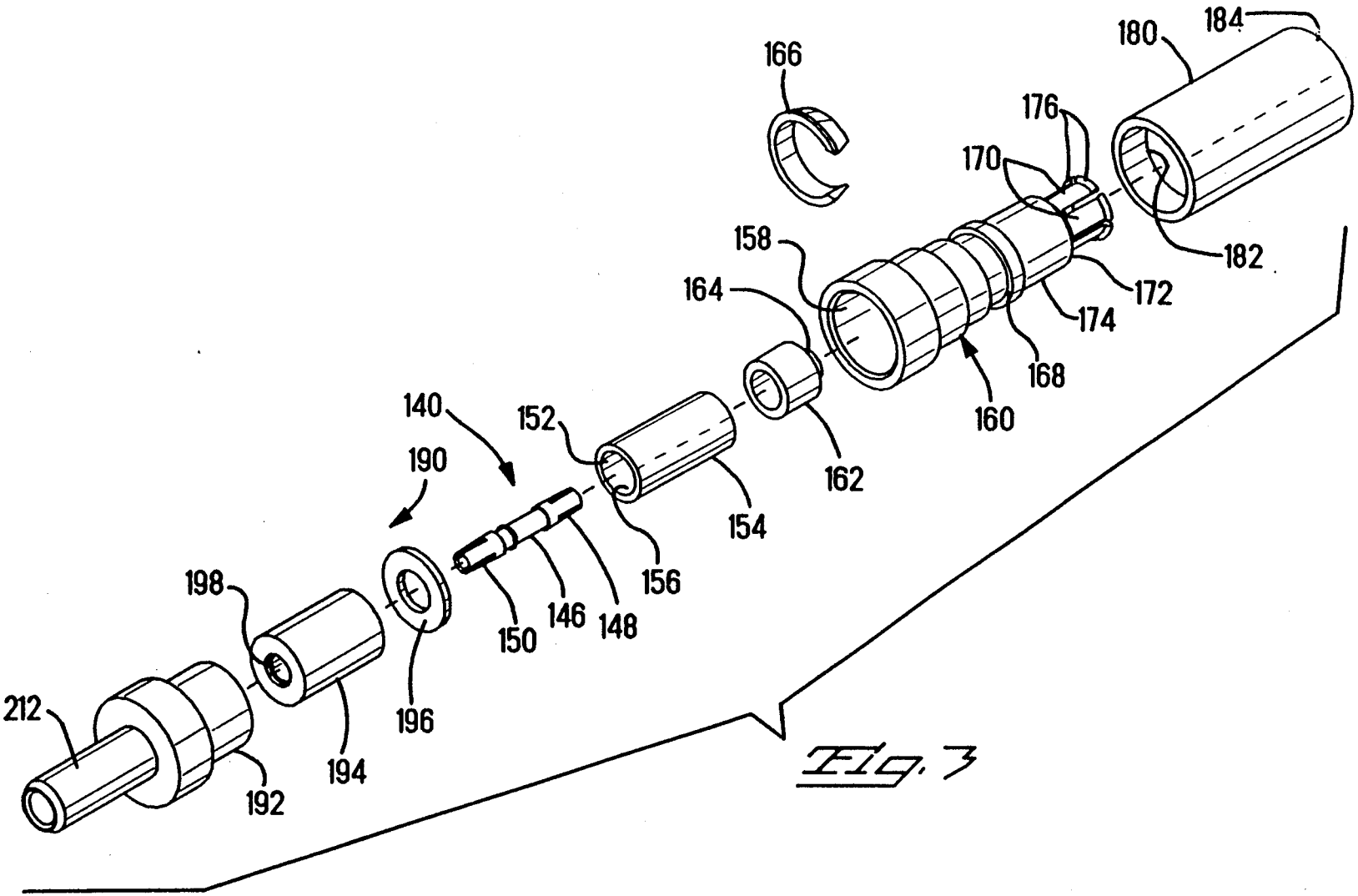

Regarding FIGS. 1 and 3, jack connector 140 is seen to include an inner or central contact 146 having a socket contact forward section 148 matable with the pin contact forward section 62 of contact 46 of plug 40, and also having a socket contact rearward section 150. Inner contact 146 is mounted within a passageway 152 of rear dielectric body 154 with forward contact section 148 extending forwardly thereof, and rearward contact section 150 exposed within the rearward shroud section 156 thereof. Inner contact 146 and rear dielectric body 154 are secured within bore 158 of unitary outer shell 160, along with front dielectric body 162 which is disposed around socket contact forward section 148 and includes a reduced diameter forward section 164 extending to a forward end 165 forwardly of the front end of socket contact section 148. The inner surface of front body 162 is spaced radially from the spring arms of socket contact forward section 148 permitting outward deflection thereof by pin contact section 62 upon connector mating (see FIGS. 6 to 9), while small diameter flanged front end 164 thereof defines a relatively rigid chamfered entrance for pin contact section 62 upon mating, thereby aligning the pin with the center of the spring arms of the socket, and also has an outer diameter selected to optimize achievement of 50 ohm impedance rearwardly of forward end 165.

As in plug connector 40, a retention snap ring 166 is disposed around outer shell 160 of jack 140 within an annular recess 168 to cooperate with reduced diameter rear aperture portion 32 of aperture 22 of housing 14 and latch forwardly of ledge 34 thereof. Outer shell 160 includes an array of spring arms 170 extending forwardly of the reduced diameter leading end 172 of cylindrical portion 174 to respective leading ends 176 having outwardly extending arcuate axially rounded embossments to provide conductive engagement between the outer conductors of the plug and jack connectors, and shaped to accommodate bearing engagement and initiate slight radially inward deflection upon initial engagement with the outer conductor of plug 40.

Additionally jack connector 140 also includes a conductive shroud member 180 mounted in aperture 22 having a rear inwardly directed annular flange 182 which latches behind retention snap ring 166 and forwardly of ledge 34, and has a forward section 184 extending forwardly of mating face 18 of connector 14 upon assembly; shroud 180 provides shielding around the mating interface of the inner and outer conductors of the plug and jack connectors when mated, and also serves to precisely align the plug and jack during mating, as is conventional.

FIGS. 1 and 3 also show an adapter 190 mountable at transition interface 144 of jack 140 and having a rear shell 192, rear dielectric body 194 and spacer 196. Adapter 190 provides for crimping of a terminated coaxial cable to jack 140 at the transition interface, as shown in FIG. 5.

In the preferred embodiment of the invention, contact 146 and outer shell 160 may be machined of beryllium copper and subsequently plated with gold over nickel. Dielectric bodies 154 and 162 may be PTFE, and retention snap ring may be nickel-plated beryllium copper while conductive shroud 180 may be nickel-plated brass. Rear shell 192 and spacer 196 may be nickel-plated brass, and rear dielectric body 194 may be PTFE.

Figure 4:
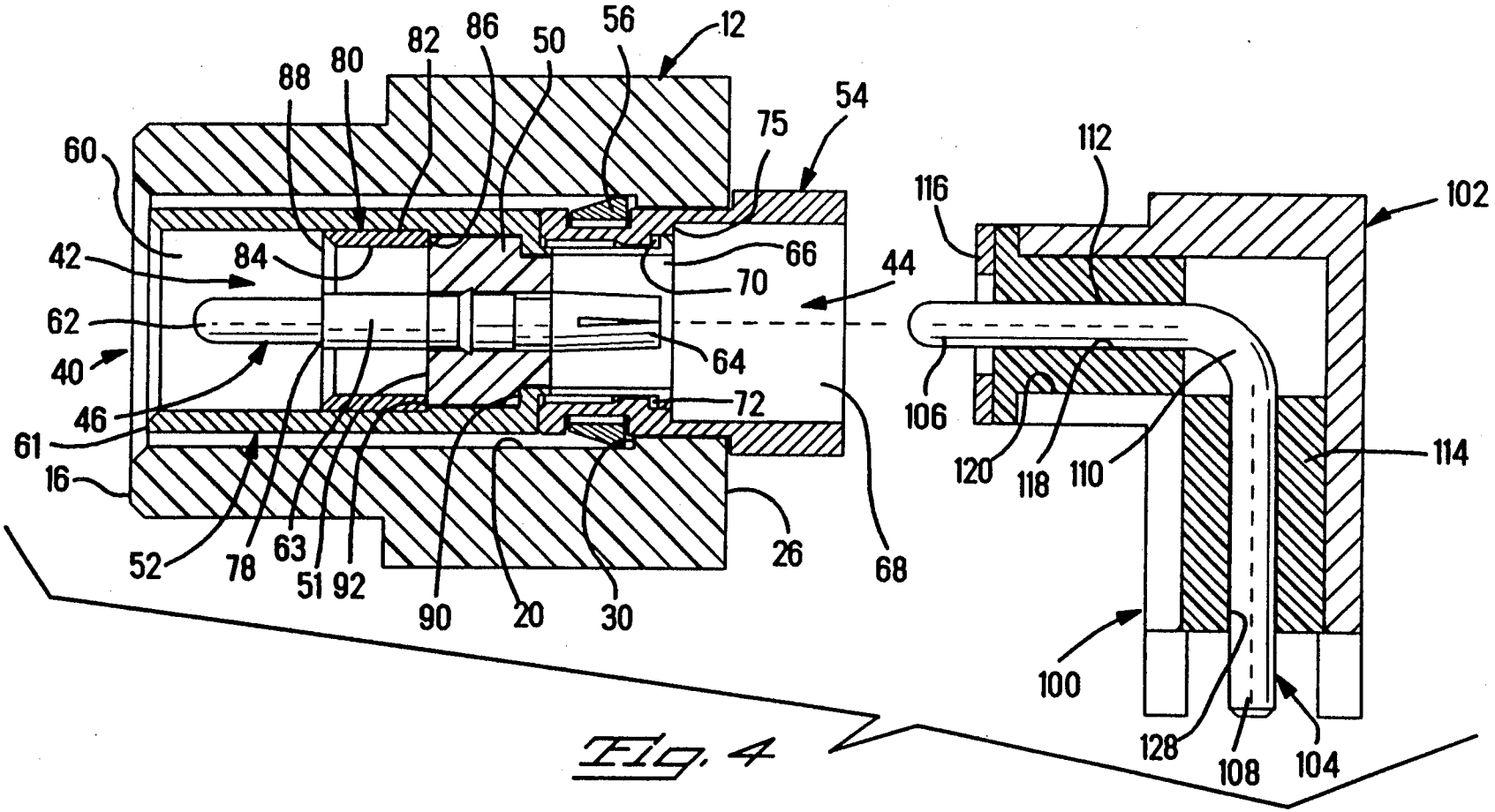
FIGS. 4 and 5 are longitudinal section views of the connectors of FIGS. 2 and 3 respectively, with circuit board connectors and cable connectors exploded therefrom at transition interfaces respectively.

In accordance with the present invention, and referring to FIGS. 4 and 2, inner conductive sleeve 80 of plug 40 has an outwardly facing surface 82, inwardly facing surface 84, rear edge 86 and inwardly chamfered leading edge 88. The outer diameter of inner sleeve 80 is incrementally greater than the inner diameter of the front portion of bore 60 of front shell 52 to define an interference fit when inserted thereinto. Dielectric body 50 is preferably machined of somewhat resilient material to have an axial length just greater than the distance between rear flange 90 of front shell 52 and annular ledge 92 along bore 60. Inner sleeve 80 is inserted into bore 60 of front shell 52 forwardly of dielectric body 50 until abutting against forwardly facing annular ledge 92, engaging forward end 51 of dielectric body 50 and slightly compressing the resilient material of dielectric body 50 against rear flange 90, thus tending to fill any incremental gaps between dielectric body 50 and front shell 52. Inner sleeve 80 thus serves as a retention means for dielectric body 50. The length of inner conductive sleeve 80 is selected so that upon assembly, leading edge 88 is axially coincident with shoulder 78 between pin contact section 62 and larger diameter body section 63 of contact member 46, and rearward edge 86 abutting and coincident with forward end 51 of dielectric body 50.

Figure 5:
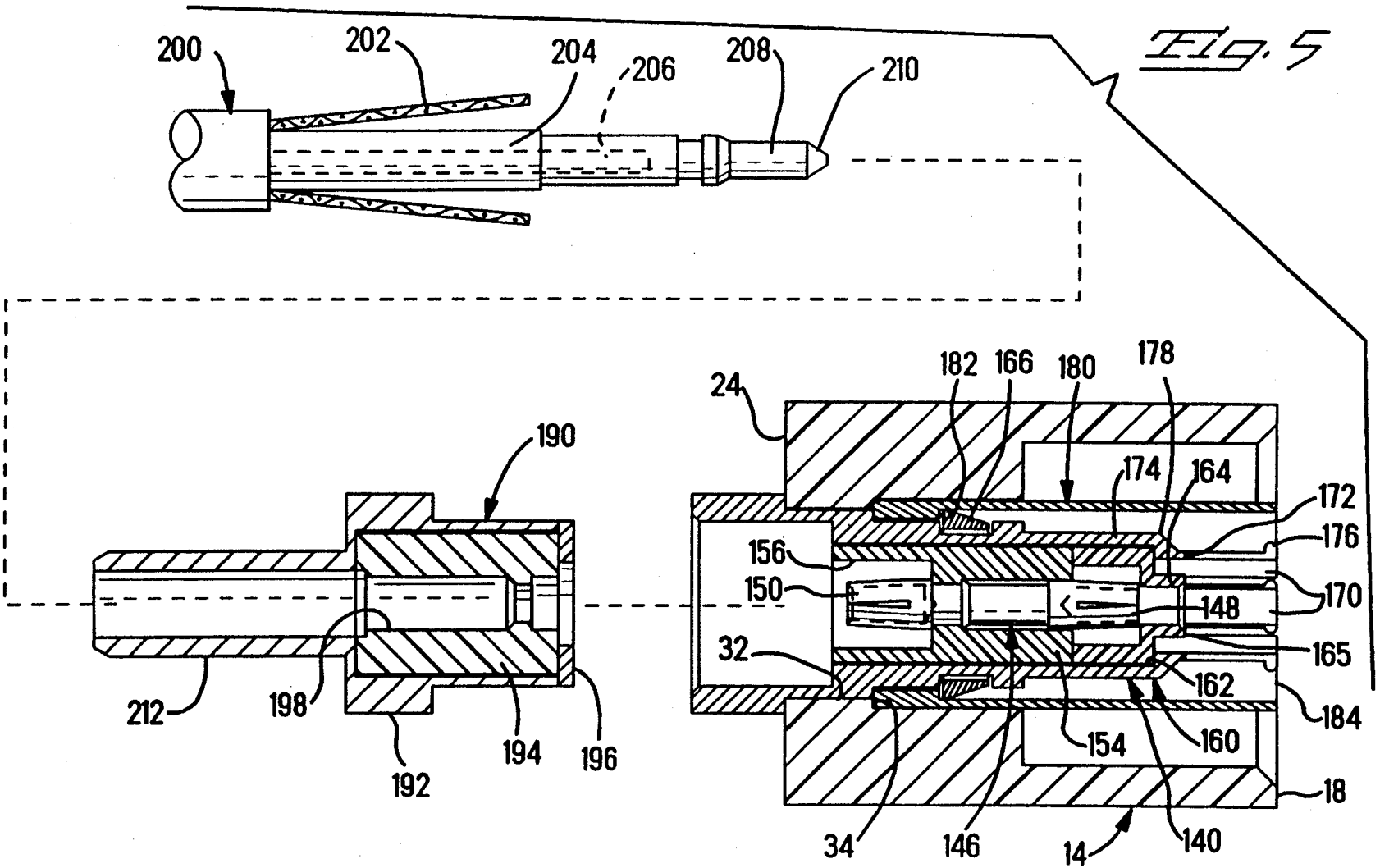

In FIG. 5, unitary outer shell 160 of jack 140 includes a transition section 178 between cylindrical portion 174 having a diameter selected to fit within front shell 52 of plug 40, and leading end 172 and spring arms 170 thereof having a reduced diameter complementary to the inner diameter of inner sleeve 80 within which spring arms 170 will be received upon mating. Transition section 178 is tapered, and the leading end of front shell 52 is chamfered, all to facilitate receipt of cylindrical portion 174 of unitary outer shell 160 within front shell 52. Leading edge 88 of inner sleeve 80 is chamfered to facilitate initial engagement with leading edges 176 of spring arms 170 of unitary outer shell 160 of jack connector 140 upon mating, and radially inward deflection of spring arms 170 assuring spring biased engagement with inner sleeve 80 of plug 40 for assured electrical grounding engagement radially around contact member 46.

With respect to FIGS. 4 and 5, right angle circuit board connector 100 is shown being connected to transition interface 44 of plug 40, with spacer 116 disposed between outer shell 102 and shoulder 75 within the rearward portion of bore 68 of rear shell 54; preferably connector 100 is mounted to transition interface 44 prior to assembling plug 40 into housing 12, such as by force-fit of the cylindrical portion of shell 102 into the rearward end of rear shell 54. In FIG. 5, adapter 190 is being assembled to transition interface 144 of jack 140, with spacer 196 disposed between outer shell 192 and conductive shell 160. Assembly may be accomplished by force-fit of the forward end of adapter shell 192 into the rearward end of outer shell 160 of jack 140. Adapter 190 defines a passageway 198 extending inwardly to rear socket contact section 150 of contact 146. Coaxial cable end 200 includes an exposed shielding braid section 202 coextending over an insulated inner conductor portion 204 forwardly from which extends inner conductor 206 having a terminal 208 terminated thereto such as by crimping and concluding in a pin contact section 210.

Figure 6:
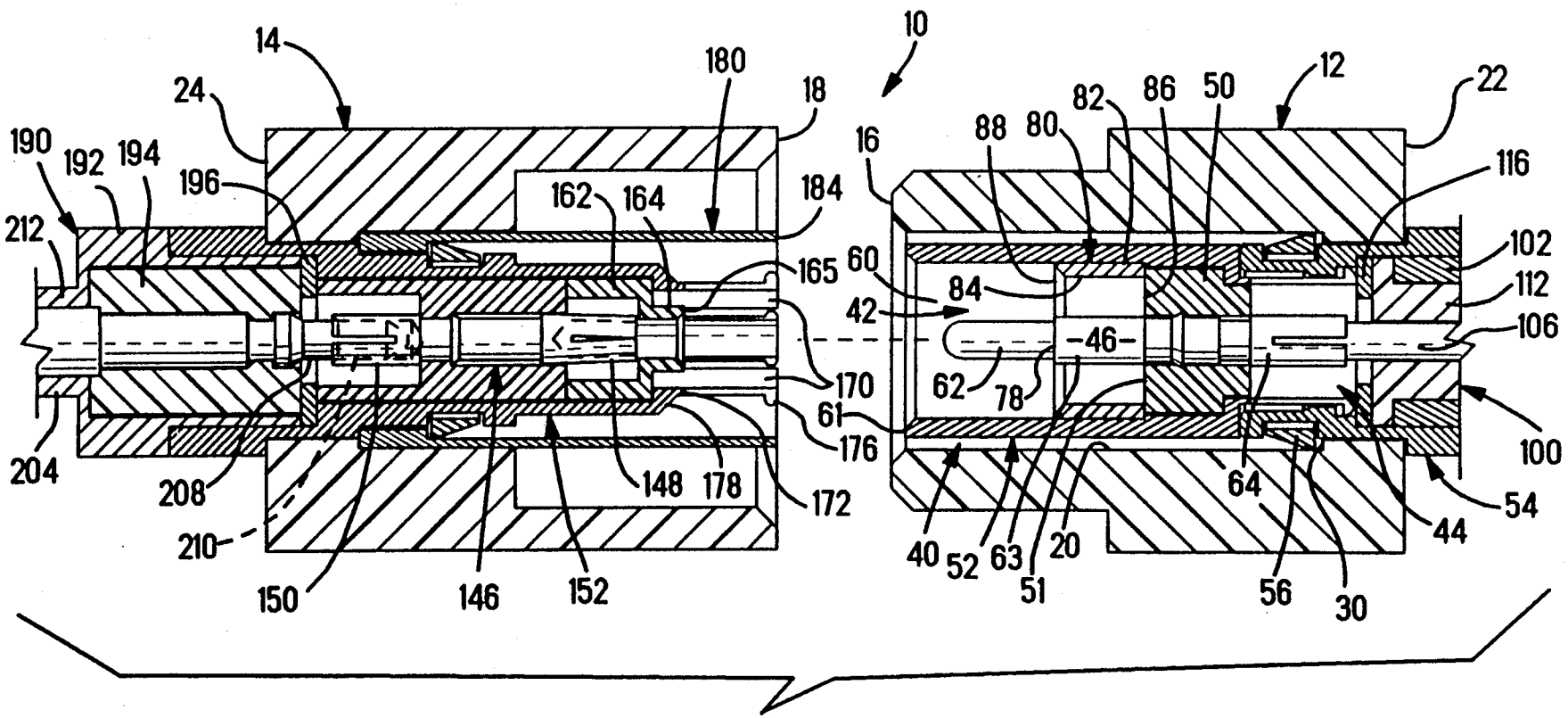
FIGS. 6 and 7 are longitudinal section views of the connectors of FIGS. 4 and 5 positioned to be mated, and fully mated respectively.
Figure 7:
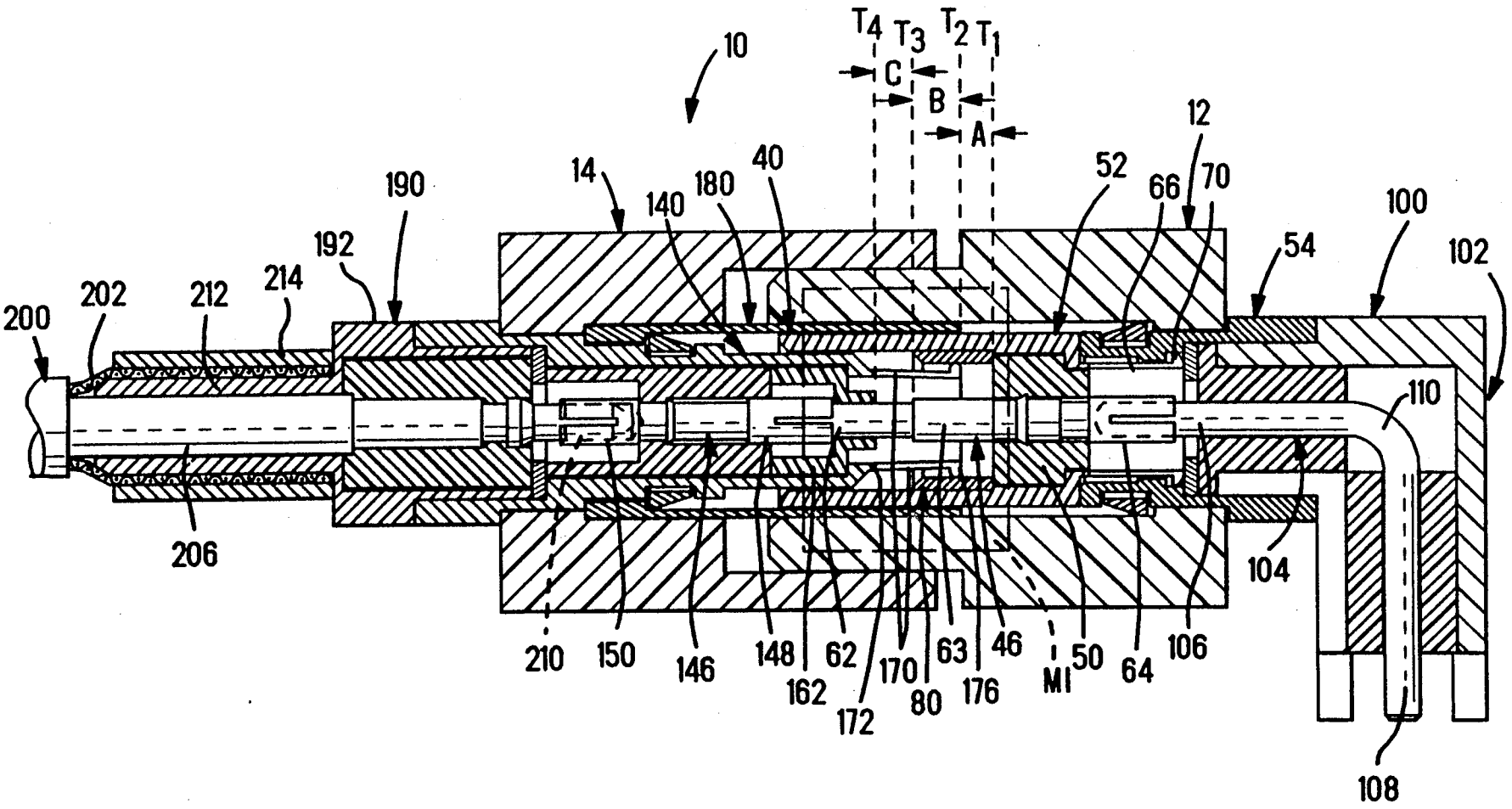

In FIGS. 6 and 7 coaxial cable end 200 is shown connected to jack 140 with adapter 190, with cylindrical flange section 212 of adapter shell 192 having shielding braid 202 crimped thereover using a crimping ferrule 214 to establish a ground connection for the braid; pin contact section 210 of terminal 208 has been matingly received into socket contact section 150 of contact 146 to establish the signal connection between the cable and jack 140.

FIG. 7 is a longitudinal of the mated connector assembly 10 comprising plug 40 with circuit board connector connected thereto, and jack 140 with cable 200 connected thereto. Plug 40 and jack 140 are mated at their complementary mating faces 42,142 to define the mating interface, the region being designated herein as MI for discussion of FIGS. 8 and 9. Forward end 184 of shroud 180 is received into aperture 20 of housing 12 and around leading end 61 of front shell 52, and leading ends 176 of spring arms 170 enter bore 60 of front shell 52 around pin contact section 62. Inwardly chamfered leading end 61 of front shell 52 engages outwardly tapered transition section 178 of unitary outer shell 160, becoming precisely aligned and positioned with respect thereto, after which leading ends 176 of spring arms engage inwardly chamfered leading end 88 of inner conductive shell 80 and are deflected slightly radially inwardly. Pin contact section 62 enters inwardly chamfered forward end 165 of forward section 164 of front dielectric body 162 and is precisely aligned thereby to eventually enter socket contact section 148 spaced rearwardly thereof. The final axial fully mated relationship of plug 40 and jack 140 is determined by other features of connector housings 12,14.

Figure 8:
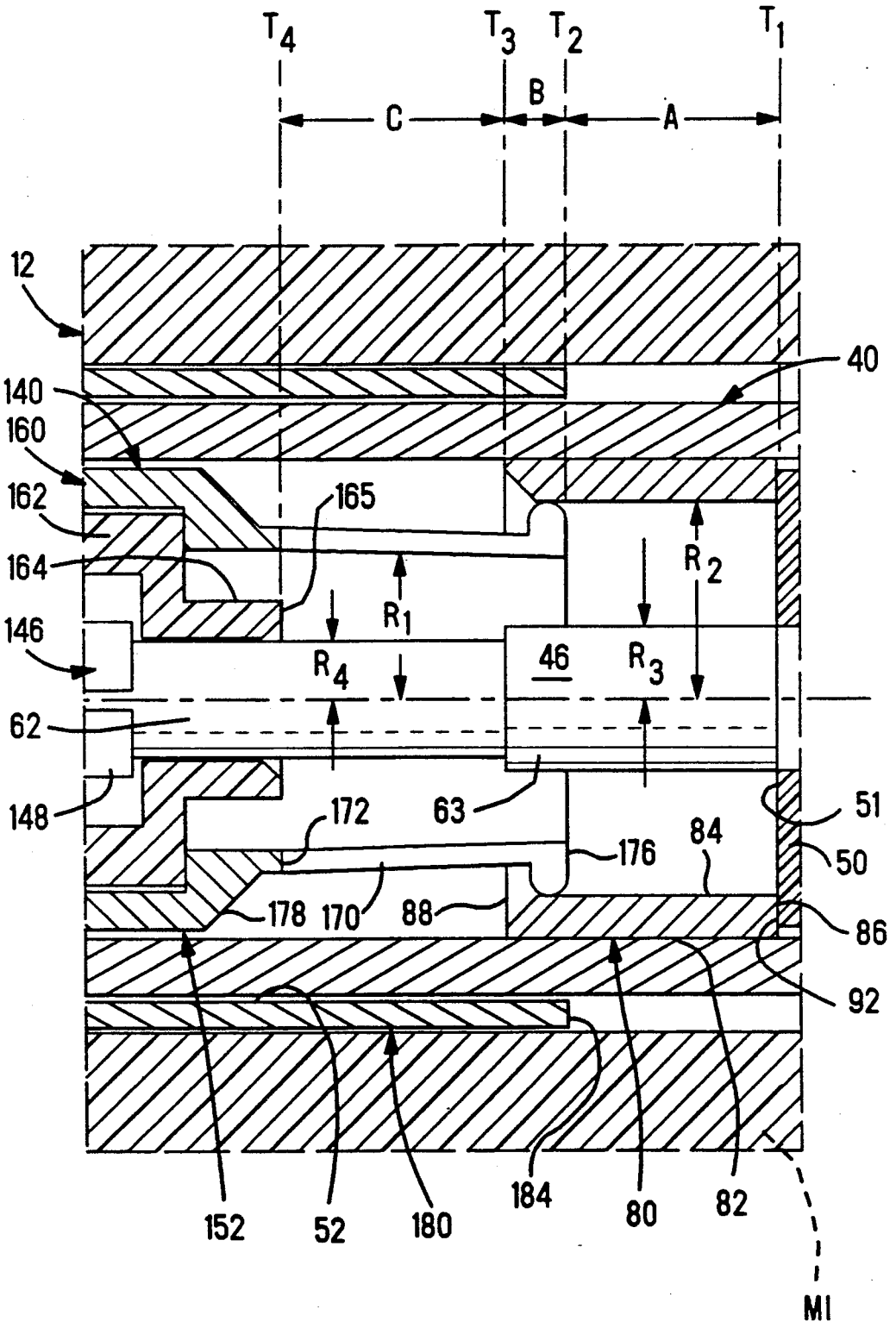
FIGS. 8 and 9 are enlarged longitudinal section views of the mating interface of FIG. 7 with the connectors mated at extreme positions of the axially mated range.
Figure 9:
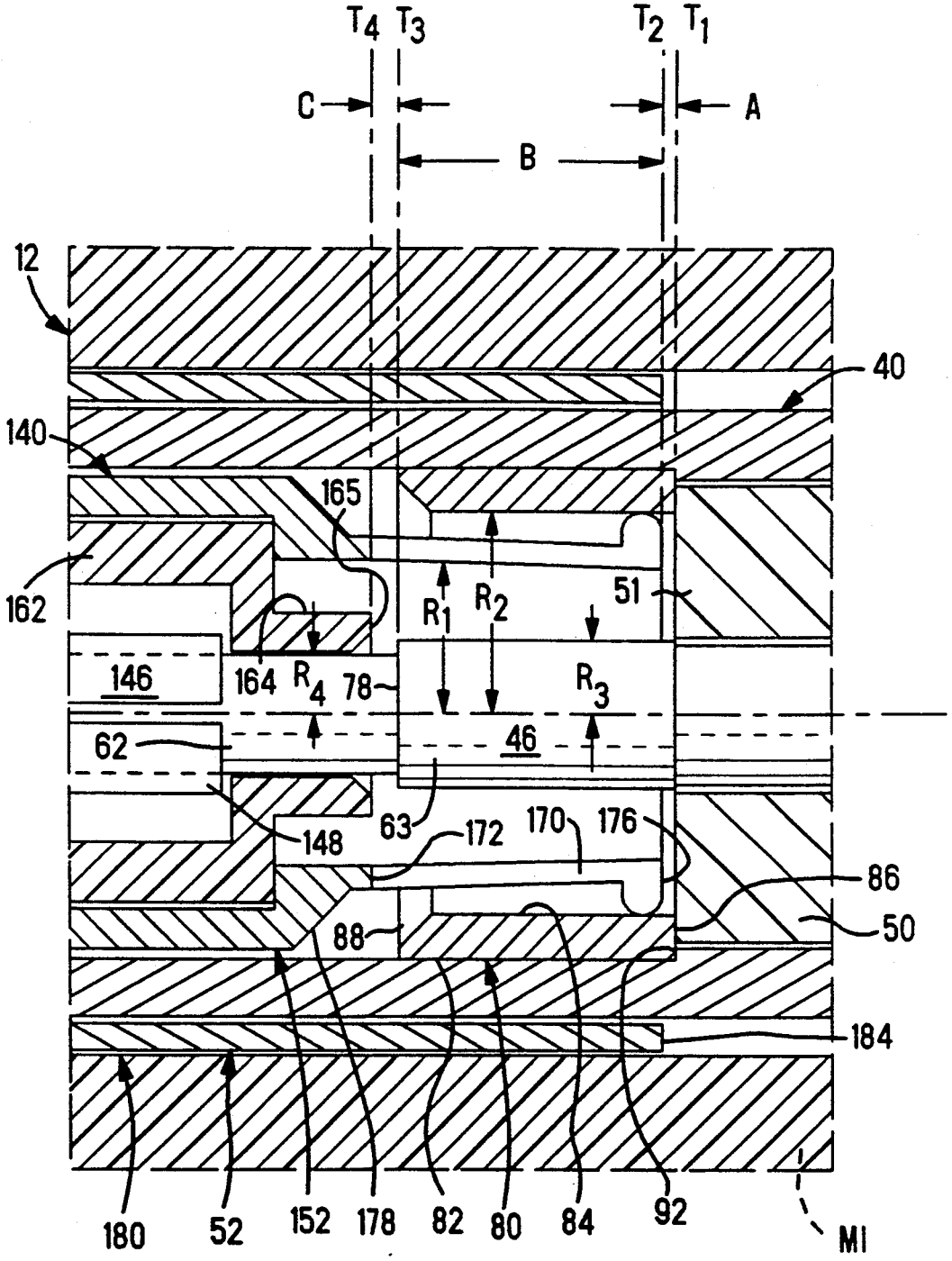

The impedance of any coaxial connector is a function of the inner diameter of the outer conductor, the outer diameter of the inner conductor and the dielectric that separates the two. As shown in FIGS. 8 and 9, the selfcompensating section of the present invention has three variable sections of impedance A, B and C defined by four transitions from impedance of one level to the impedance of another level. The section A is the distance between forward end 51 of dielectric body 50 and the leading edge 176 of spring arms 170 of outer shell 160; section B is the distance between leading edge 176 of spring arms 170 and shoulder 78 on pin contact section 62 which is preferably axially coincident with forward edge 88 of sleeve 80; and section C is the distance between shoulder 78 and forward end 165 of forward section 164 of front dielectric body 162. Thus it should be appreciated that the sections A–C vary in length with the axial displacement of the pin contact section 62 relative to the socket contact section 148. The impedance through the section of contact member 46 within front shell 52 rearwardly of forward end 51 of dielectric body 50 is nominally 50 ohms, as is the forward or mated portions of pin contact section 62 and socket contact section 148 within continuous cylindrical portion 174 of unitary outer shell 160 rearwardly of the forward end 165 of front dielectric body 162.

However, the sections A, B and C do not have nominal impedances of 50 ohms, but rather the impedance of sections A and C is greater than 50 ohms, whereas the impedance of section B is less than 50 ohms. The impedance of section A is a function of the diameter of body section 63 of contact member 46 rearwardly of shoulder 78 or twice the radius $R_3$, the inner diameter of conductive inner shell 80 or twice the radius $R_2$, and the dielectric effect of the air between the two. The impedance of section B is a function of the diameter ($2R_3$) of body section 63 of contact member 46, the inner diameter (or $2R_1$) of the spring arms 170 of unitary outer shell 160 forwardly of cylindrical section 174 (after slight radially inward deflection upon engagement with inner sleeve 80), and the dielectric effect of the air between the two. Finally, the impedance of section C is a function of the diameter of pin contact section 62 ($2R_4$), the inner diameter ($2R_1$) of spring arms 170, and the dielectric effect of the air intermediate the two.

It should be appreciated then that unitary outer shell 160 and contact member 146 can vary axially between the positions shown in FIGS. 8 and 9 relative to front shell 52 and contact member 46. This floatation changes the lengths of the sections A–C, due to the overlapping effect of unitary outer shell 160 of jack 140 with both pin contact section 62 and the larger diameter body portion of contact member 46 of plug 40. The change in the length of sections A–C does not change the magnitude of the impedance but, rather, only changes the phase angle through which the impedance operates. Four such reflections occur, one at each of the transition sections $T_1$–$T_4$, as shown in either of FIGS. 8 and 9, due to the instantaneous change in impedance. The reflection at $T_1$ is due to the change of impedance between the nominal impedance value of 50 ohms and the impedance value of zone A, likewise the reflection at $T_4$ is due to the change of impedance between the nominal impedance value of 50 ohms and the impedance value of zone C. The reflections at $T_2$ and $T_3$ are due to the change of impedance between zones A and B, and B and C, respectively.

With reference now to FIGS. 7 to 9, plug half 40 and jack half 140 are shown in their nominal condition in FIG. 7 when the hybrid connector housings 12,14 are fully mated. It should be appreciated that as the jack half 140 is further to the left of nominal, as viewed in FIG. 8, the length of zone B is decreased between the leading ends 176 of spring arms 170 and shoulder 78 of contact member 46. In FIG. 9, jack 140 is further to the right of nominal, and the length of zone B is increased. Such variation in relative axial position of plug 40 and jack 140 occurs as a result of tolerances in the hybrid connector housings 12,14 and in each of the plug connector 40 and jack connector 140. The present invention can easily accommodate the additive tolerance limits of 0.030 inches in the connector housings and 0.030 inches in the plug and jack connectors, or a total of 0.060 inches and still perform well within nominal performance requirements at 10 gigaHertz and even up to about 30 gigaHertz.

In the preferred embodiment of the invention, the impedance values of zones A–C are 60.289, 42.583 and 57.577 ohms, respectively, and the length in inches of zones A–C, in the positions shown in FIGS. 7–9, are as follows:

| | Zone A | Zone B | Zone C |
|---|---|---|---|
| FIG. 8 | 0.065" | 0.0205" | 0.0695" |
| FIG. 7 | 0.035" | 0.0505" | 0.0395" |
| FIG. 9 | 0.005" | 0.0805" | 0.0095" |

Furthermore, in the preferred embodiment of the invention, and with reference to FIG. 8, the inner diameter of the spring arms 170 of unitary outer shell 160 is $2\ R_1$ or 0.094 inches, the inner diameter of the inner conductive sleeve 80 is $2\ R_2$ or 0.124 inches, the outer diameter of contact section 63 rearwardly of shoulder 78 is $2\ R_3$ or 0.045 inches, the outer diameter of the pin contact section 62 is $2\ R_4$ or 0.036 inches.

As mentioned above, the movement of the spring arm leading ends 176 between the positions of FIGS. 7 to 9, is such that, in each position, the reflections at $T_1$–$T_4$ are substantially self-canceling. This is accomplished by designing the mating interface MI of the connector, such that in each of the positions, shown in FIGS. 7 to 9, the sum total of the reflected signals, that is considering both the magnitude and phase angle, are substantially self-canceling. The dimensions provided above have provided such a result.

Figure 10:
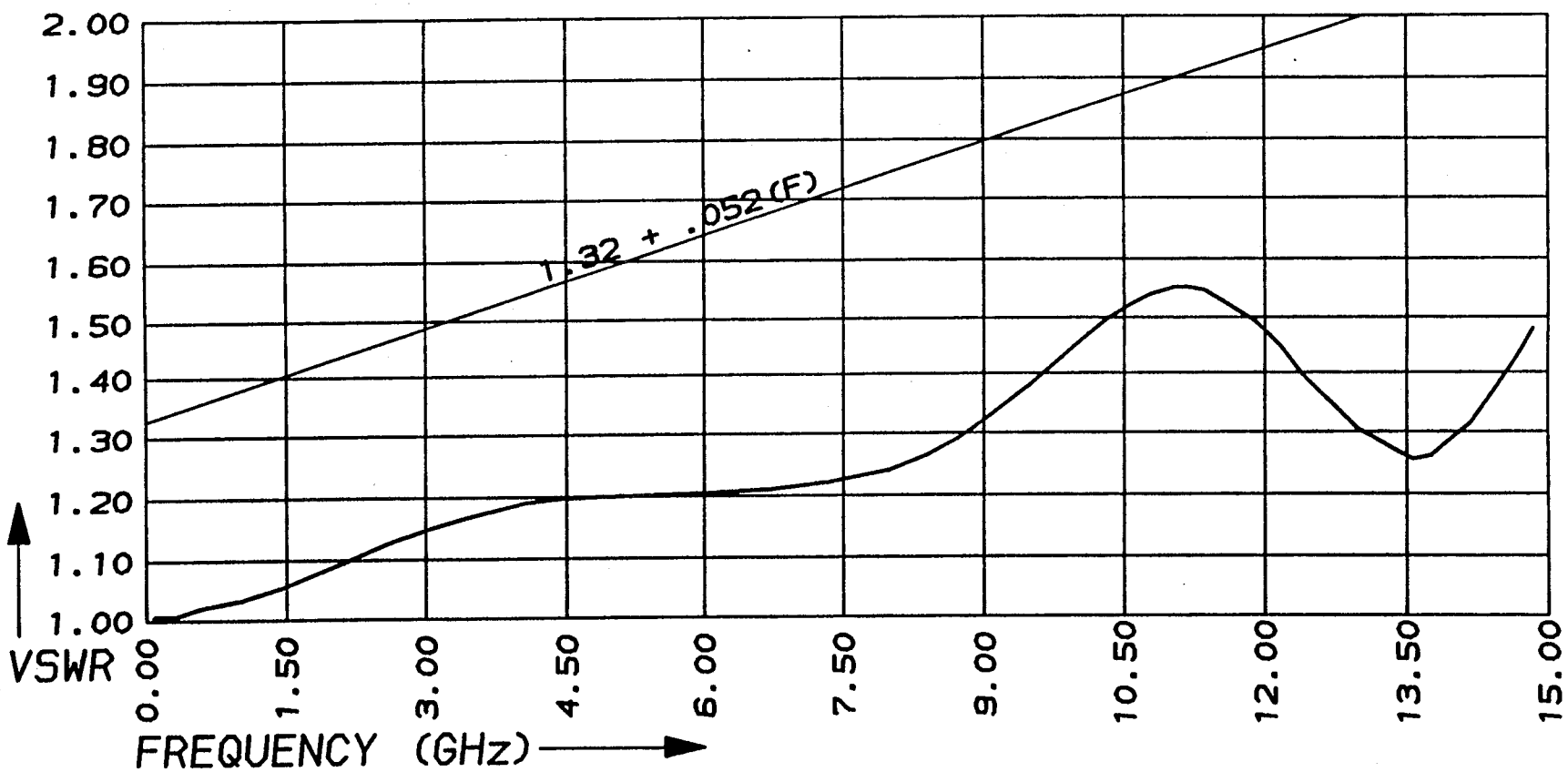
FIGS. 10 to 12 are graphs of the VSWR versus frequency in gigaHertz for the mated positions of FIGS. 7 to 9 respectively.
Figure 11:
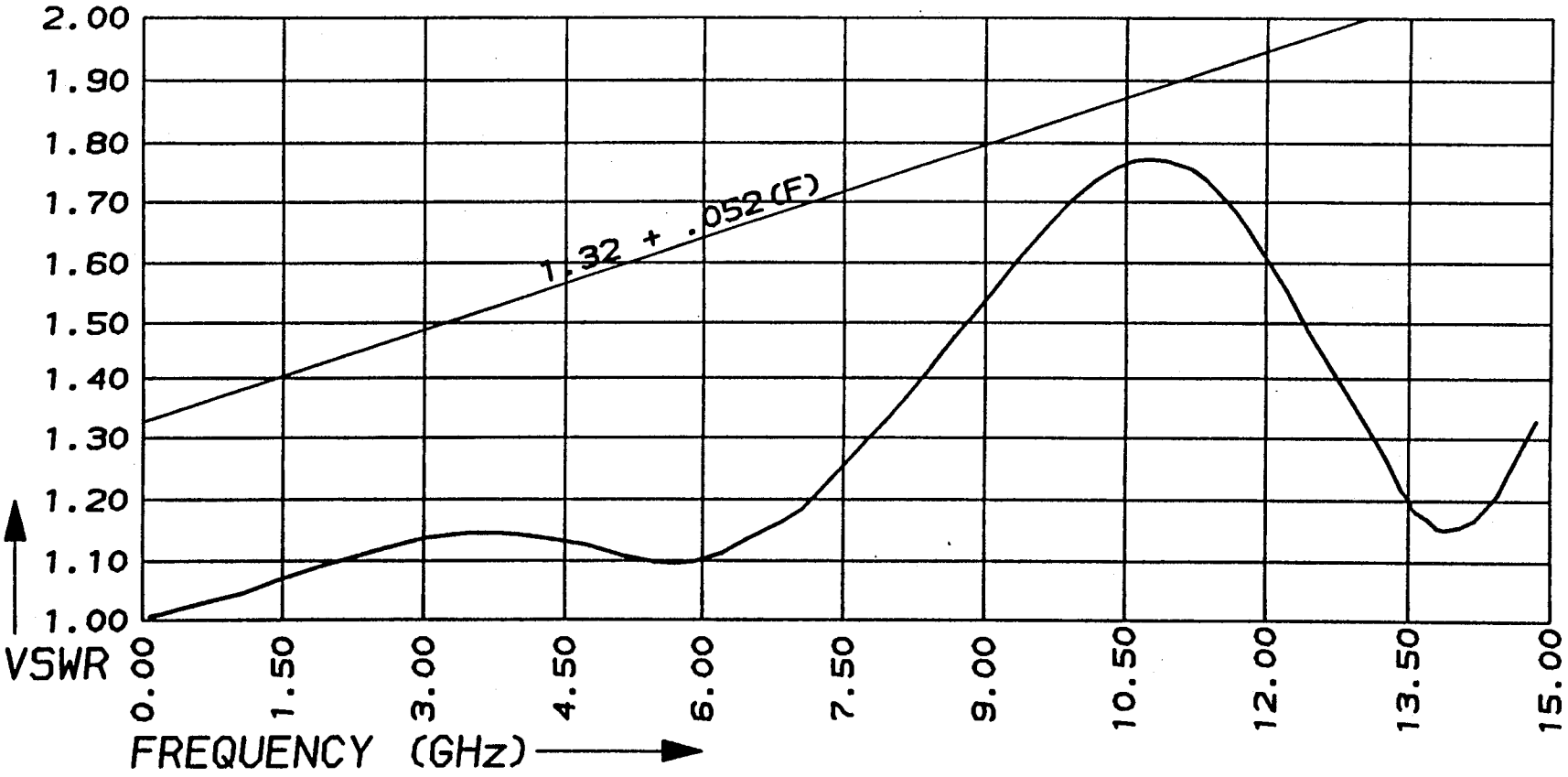

The graph of FIG. 10 refers to the position shown in FIG. 7: the maximum VSWR is 1.54 which translates to transmitted power of 95.5% at the input signal with a 4.5% reflected signal. In FIG. 11, the graph refers to the position shown in FIG. 8: the maximum VSWR is 1.64 which translates to transmitted power of 94.1% of the input signal with a 5.9% reflected signal. And the graph of FIG. 12 refers to the position shown in FIG. 9: the maximum VSWR is 1.77 which translates to transmitted power of 92.2% of the input signal with a 7.8% reflected signal.

Figure 12:
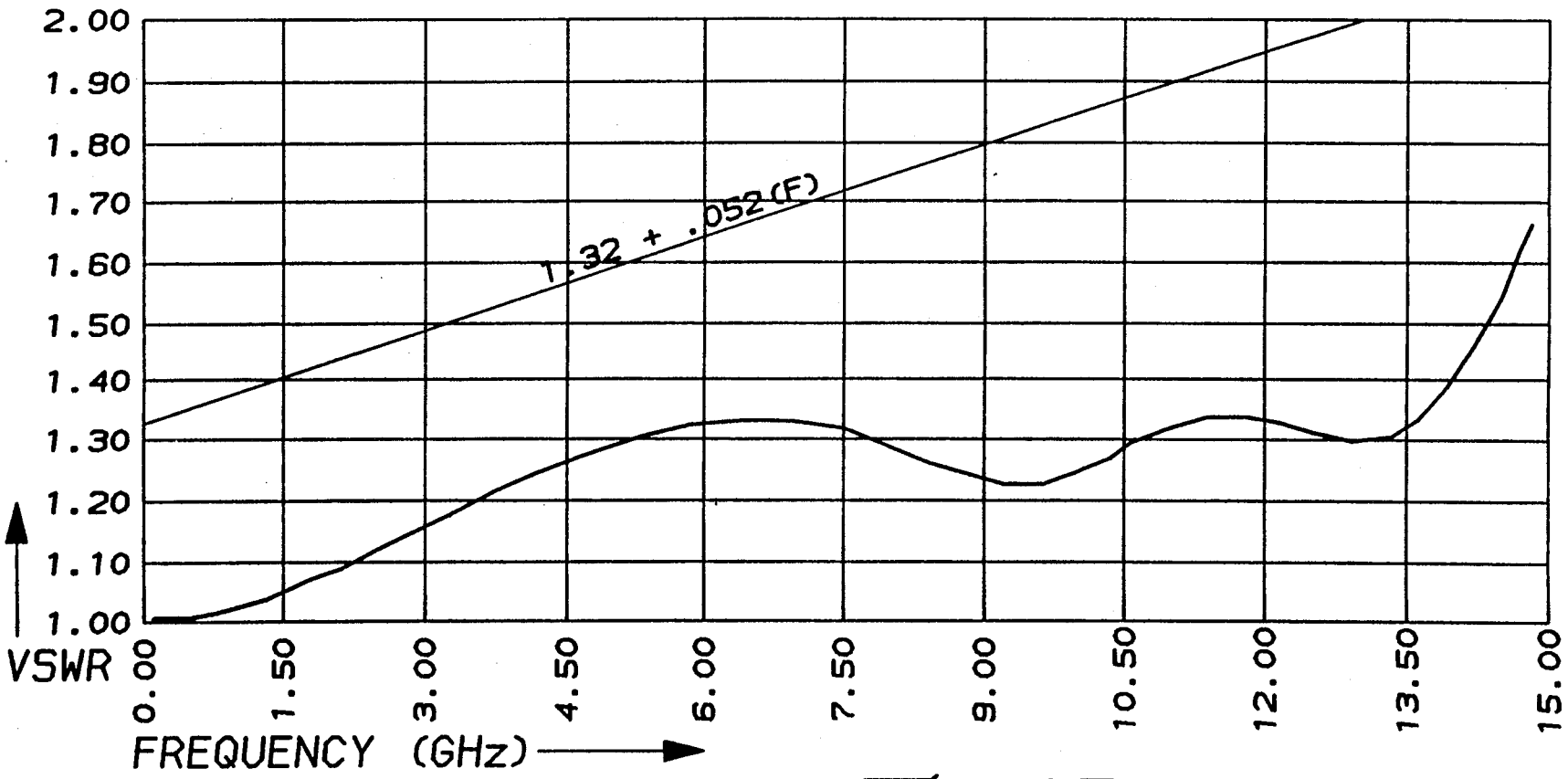
Figure 17:
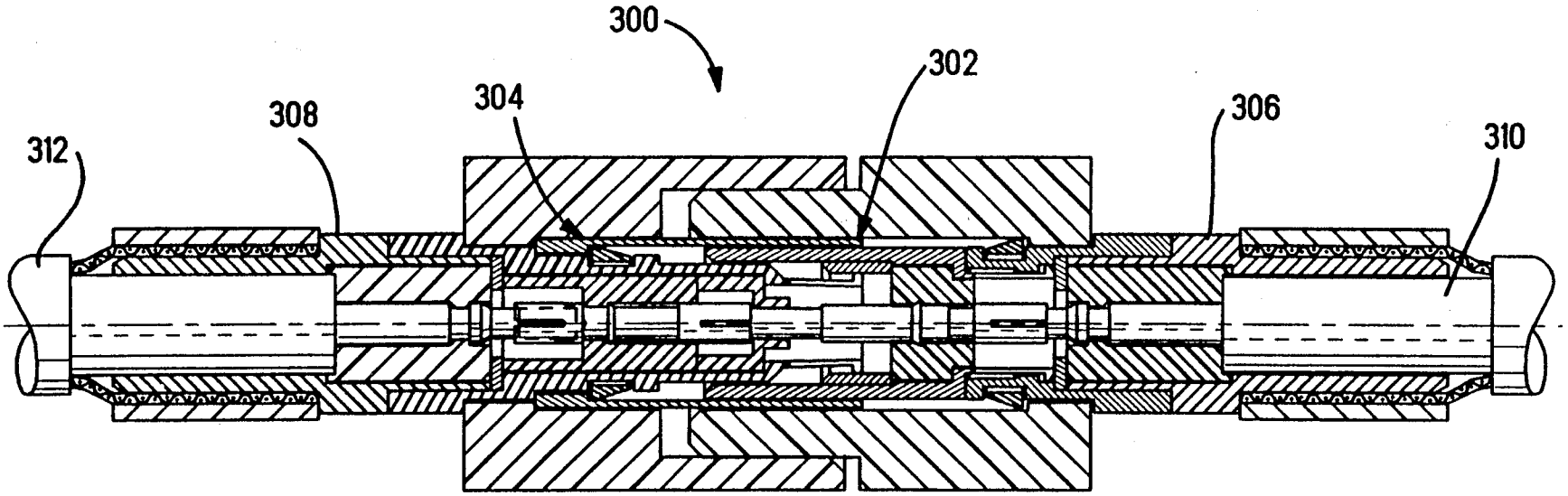

The straight line graph in FIGS. 10 to 12 is a graphic representation of the formula $$Max\ VSWR = 1.32 + (0.052 \times F)$$

where

F = frequency in Gigahertz

This formula represents performance which would be considered acceptable in the industry for a coaxial connector mounted in a multiposition hybrid connector, such as one having a plurality of coaxial connectors mounted in matable housings for simultaneous mating.

Figure 14:
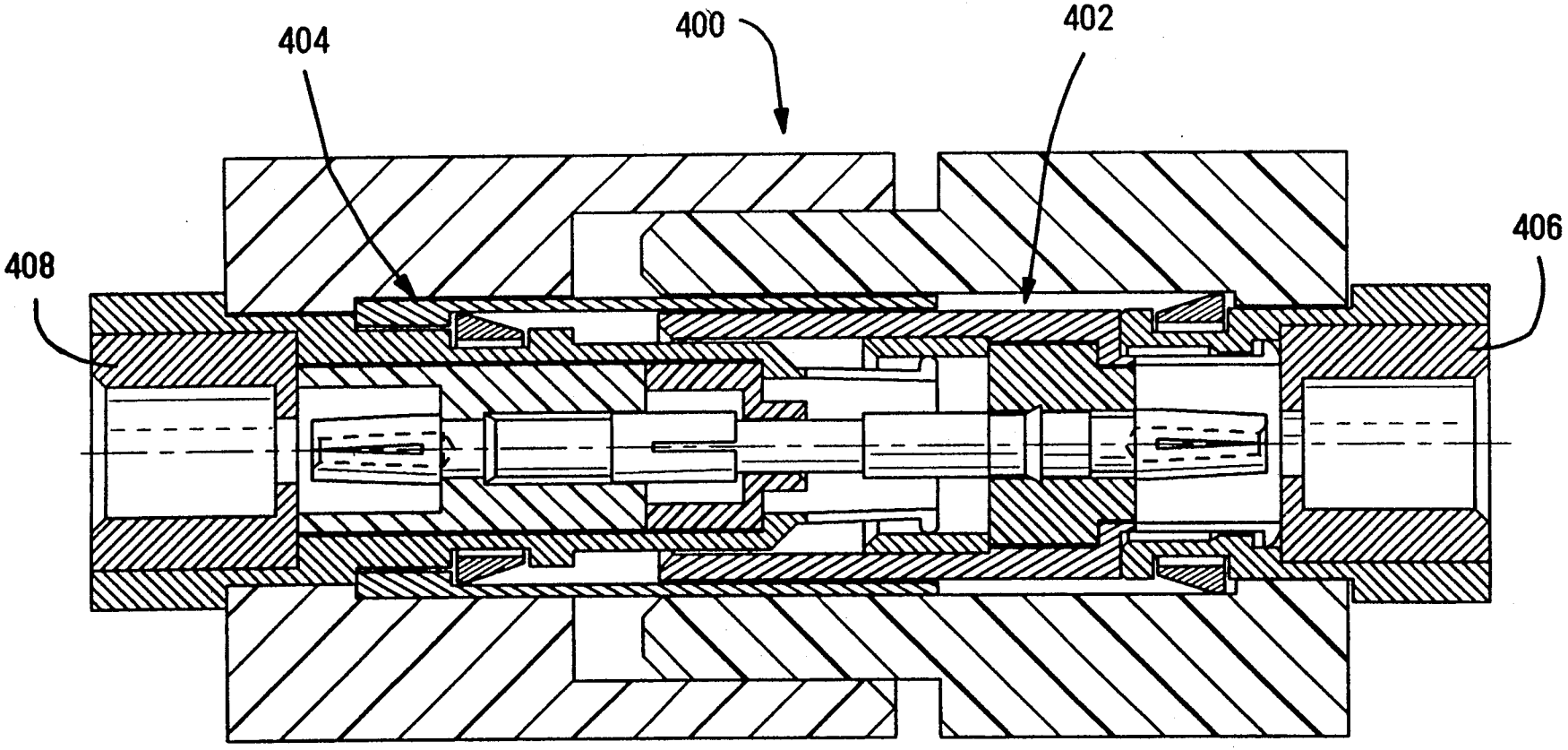
Figure 15:
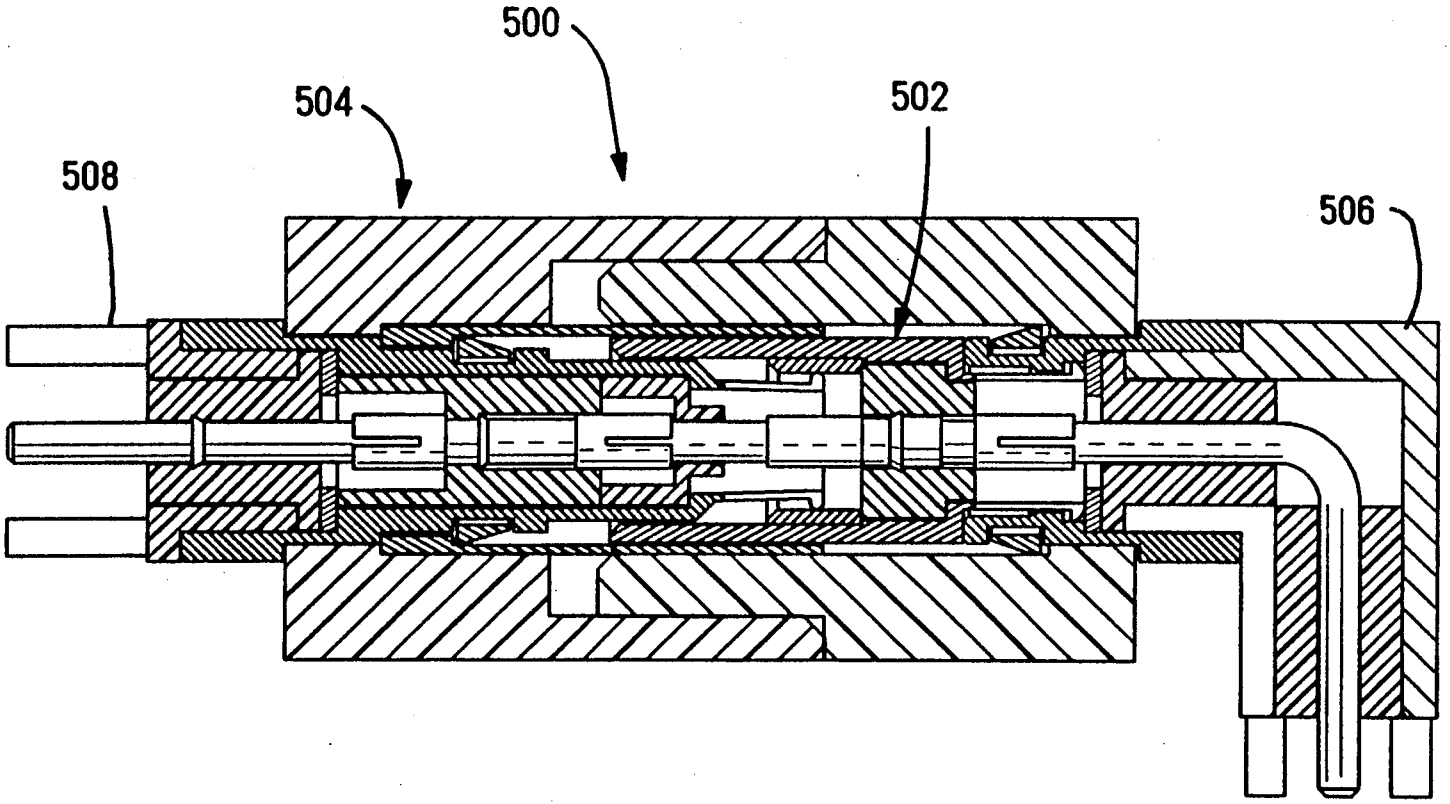

FIGS. 13 to 15 illustrate similar coaxial connector assemblies containing the selfcompensating mating interface of the present invention. FIG. 13 shows an assembly 300 of plug connector 302 and jack connector 304, both adapted for cable-to-cable interconnection using adapter assemblies 306,308 for crimp terminations to the coaxial cables 310,312, similar to the crimp termination of jack 140 to cable 200 of FIGS. 5 to 7 using an adapter assembly 190. FIG. 14 shows an assembly 400 of plug connector 402 and jack connector 404, both adapted for cable-to-cable interconnection using inner conductive adapters 406 for solder termination to the outer conductor of semirigid coaxial cables (not shown). FIG. 15 shows an assembly 500 of plug connector 502 and jack connector 504, having circuit board connectors 506,508 respectively connected at transition interfaces 510,512 respectively, with circuit board connector 506 being similar to right angle connector 100 of FIGS. 1 to 7 and circuit board connector 508 being a straight-out connector for vertical mounting to a circuit board, for example.

In addition to providing selfcompensating impedance accommodating axial variations in mated positions of hybrid connectors, the embodiments disclosed herein retain the advantage provided in the mounting of the plug and jack coaxial connectors in the hybrid connector housings which accommodates incremental variations in alignment of centerlines of the respective cavities of the housings in which the coaxial connectors are mounted, by permitting relative incremental angular adjustment of the plug and jack. This characteristic is particularly useful in board-to-board arrangements where the connectors are rigidly mounted to the respective boards in approximately corresponding locations suitable for mating when the boards are moved together but which require the ability to incrementally selfadjust spacial and angularly to precisely mate in a manner which provides an impedance matched coaxial connection.

Further, the embodiments require no compression spring means to achieve the selfcompensating impedance characteristics, and thereby result in substantially decreased resistance to mating required to compress the springs to achieve bottoming of the reference planes as in the commercial "Blind Mate" connector design, which amounts to about five pounds per spring, discouraging use of more than two or three such connectors in hybrid connector assemblies and also discouraging disassembly thereof for repair or replacement.

The present invention has been disclosed in particular embodiments shown and described with respect to FIGS. 1 to 15, but may be useful in other embodiments of coaxial connectors. Further, variations and modifications may occur which are within the spirit of the invention and the scope of the claims.

I claim:

1. A coaxial connector assembly of the type having a plug connector and a jack connector matable therewith at a mating interface, each having an inner conductor concentrically held within dielectric bodies within an outer conductive means extending from a mating face to a rearward face for coaxial connection to other coaxial articles, each inner conductor and outer conductive means having respective precise radially spaced surfaces therebetween at each axial location therealong, the plug conductor including a pin contact section of selected diameter extending forwardly of a body section and matable with a socket contact section of the jack inner conductor at the mating interface, and the plug outer conductive means including a front shell having an inner surface defining a cavity of selected inner diameter surrounding the pin contact section, and the jack outer conductive means having a cylindrical body section of selected inner and outer diameters surrounding the socket contact section and including an array of spring arms extending forwardly of the cylindrical body section adapted to engage the plug outer conductive means at the mating interface upon mating, the mating interface characterized in that:

said body section of said plug inner conductor extending rearwardly from said pin contact section defining a shoulder and having a selected diameter slightly larger than said selected diameter of said pin contact section rearwardly at least into a dielectric body forward end;

said plug outer conductive means including a reduced inner diameter section inwardly of said leading edge of said front shell and having an inwardly facing surface of selected diameter extending rearwardly to said dielectric body forward end from a first axial location axially coincident with said shoulder of said plug inner conductor, said first axial location defining an outermost limit of a range of positions of engagement of said leading ends of said spring arms of said jack outer conductive means with said plug outer conductive means; and said spring arms of said jack outer conductive means extending forwardly of a reduced diameter leading end of said cylindrical body section of said jack outer conductive means;

said mating interface including various regions of mismatched impedance axially therealong with respective lengths of said regions varying with the axial position of said plug mating face relative to said jack mating face, said regions being dimensioned to create reflection signals at transition positions between adjacent regions by varying said selected diameters of said inwardly facing surfaces of said outer conductive means of said plug and said jack and said outwardly facing surfaces of said inner conductors thereof within said mating interface, said reflection signals being substantially self canceling in summation, thereby preventing power loss.

2. The coaxial connector assembly as set forth in claim 1 further characterized in that said leading edge of said conductive sleeve includes an inwardly and forwardly facing chamfer engageable by said leading ends of said spring arms of said outer conductive means of said jack during final stages of mating to initiate slight radial inward deflection thereof.

3. The coaxial connector assembly as set forth in claim 1 further characterized in that said forward end of said outer conductive means of said jack includes a tapered outer surface portion defining a transition between said cylindrical body section and said reduced diameter leading end, thereby being adapted to precisely relatively align and center said outer conductive means of said jack and said plug upon engagement with said leading end of said outer conductive means of said plug prior to engagement of said leading ends of said spring arms with said reduced inner diameter section of said outer conductive means of said plug.

4. The coaxial connector assembly as set forth in claim 1 further characterized in that a forward end of a dielectric body of said jack is disposed outwardly of a leading end of said socket contact section of said inner conductor.

5. The coaxial connector assembly as set forth in claim 1 further characterized in that said reduced inner diameter of said outer conductive means of said plug is defined by an inwardly facing surface of a conductive sleeve member secured concentrically within said front shell forwardly of said dielectric body.

6. The coaxial connector assembly as set forth in claim 5 further characterized in that said conductive sleeve is held by force fit within said front shell.

7. The coaxial connector assembly as set forth in claim 6 further characterized in that said conductive sleeve is inserted into said front shell and engages said forward end of said dielectric body and compresses said dielectric body until a rearward edge is abutted against a forwardly facing ledge along said inner surface of said front shell at an axial location selected so that said leading edge of said conductive sleeve is axially coincident with said shoulder of said inner conductor upon assembly and assuring that said rearward edge is axially coincident with said dielectric body forward end.

8. The coaxial connector assembly as set forth in claim 1 further characterized in that said mating interface has three regions of mismatched impedances.

9. The coaxial connector assembly as set forth in claim 8 further characterized in that a first region is defined by a length of said mating interface between a forward end of said dielectric body and said leading ends of said spring arms of said outer conductive means of said jack, the length of said first region varying with the relative position of said mating faces of said plug and said jack.

10. The coaxial connector assembly as set forth in claim 8 further characterized in that a second region is defined by a length of said mating interface between said shoulder of said inner conductor of said plug and said leading ends of said spring arms of said outer conductive means of said jack, the length of said second region varying with the relative position of said mating faces of said plug and said jack.

11. The coaxial connector assembly as set forth in claim 8 further characterized in that a third region is defined by a length of said mating interface between said shoulder of said inner conductor of said plug and a forward end of said dielectric insert of said jack forwardly of said socket contact section of said inner conductor of said jack, the length of said third region varying with the relative position of said mating faces of said plug and said jack.

* * * * *